United States Patent [19]

Floros

[11] 4,417,826

[45] Nov. 29, 1983

[54] LIQUID DRIVEN ROTARY BRUSH WITH LIQUID SOAP FEEDER

[76] Inventor: Constantinos Floros, 7475 Madrid St., Brossard, Canada, J4Y 1G1

[21] Appl. No.: 334,306

[22] Filed: Dec. 24, 1981

[51] Int. Cl.[3] ..... A46B 11/02; A46B 13/06

[52] U.S. Cl. ..... 401/41; 15/29; 401/42; 401/43; 401/184

[58] Field of Search ..... 15/29; 401/42, 43, 184, 401/41, 40

[56] References Cited

U.S. PATENT DOCUMENTS

| | | | |
|---|---|---|---|
| 551,764 | 12/1895 | Haynes | 401/184 |
| 1,369,567 | 2/1921 | Smith | 15/29 |
| 2,613,381 | 10/1952 | Tucker | 401/43 |
| 4,207,640 | 6/1980 | Sekula et al. | 15/29 |

FOREIGN PATENT DOCUMENTS

| | | | |
|---|---|---|---|
| 261422 | 4/1968 | Austria | 15/29 |
| 1503906 | 7/1969 | Fed. Rep. of Germany | 15/29 |

*Primary Examiner*—Steven A. Bratlie

[57] ABSTRACT

A brush is disclosed having an elongated hollow handle and an integrally-secured casing. The casing has a shaft to which is rotatably secured a paddle wheel. The latter has a bottom surface to which are secured a plurality of bristles. The handle contains a water feed pipe which terminates in a nozzle inside the casing adapted to direct the water stream onto the paddle wheel. A liquid soap-dispensing means is provided in the shaft.

3 Claims, 7 Drawing Figures

LIQUID DRIVEN ROTARY BRUSH WITH LIQUID SOAP FEEDER

FIELD OF THE INVENTION

The present invention relates generally to bristle brushes used for washing the body, more specifically to a novel brush having a rotating element whereby the bristles also rotate for thorough cleansing and massage.

BACKGROUND OF THE INVENTION

Brushes, with or without handles, and having bristles affixed to a back have been used for bathing and washing for a long time. Yet the common brushes, as presently used, have disadvantages. For example, it is sometimes necessary to make vigourous scrubbing movements to properly cleanse one's body. For most people, perhaps, this is not a problem, but for youngsters, the elderly and very obese or corpulent people, such scrubbing may be very tiring or, at worst, impossible.

Since a good bath or shower also requires the use of soap, another disadvantage of known brushes is that they must be held in one hand and the soap held in the other for an effective soaping and brushing action. This is often difficult because soap is, of course, very slippery.

OBJECTS OF THE INVENTION

In view of the above, it is an important object of the present invention to provide a brush which eliminates the need for scrubbing by having bristles secured to a rotating head.

It is another object of the present invention to provide a brush which accomplishes the rotation of the bristles by a mechanical conversion of water pressure.

It is still another object of the present invention to provide a brush which incorporates a liquid soap-dispensing means.

It is yet another object of the present invention to provide a brush of the above type, which is simple in design and non-costly to produce.

SUMMARY OF THE INVENTION

The above and other objects and advantages of the invention are realized according to a preferred embodiment comprising a hollow handle secured to a cylindrical casing which is orthogonal to the handle, extending downwardly and made of suitable, lightweight and rigid material.

The casing is made in two detachably-secured parts, an upper section and a lower section. The upper section is hollow and secured to the handle, as mentioned above. The lower section is annular in shape and is provided with a plurality of circumferentially-spaced holes for a purpose explained below.

The upper section also includes an integrally-formed and downwardly-extending, central and cylindrical shaft whose lower end is in the plane of the annular lower section.

A vertically-oriented paddle wheel, having a plurality of blades, is rotatably mounted on the shaft. Bushing means are preferably provided between the paddle wheel and the shaft. The lower end of the paddle wheel extends outwardly defining an annular surface of slightly smaller diameter than that of the annular section and extending slightly below the lower edge of the latter. Brush bristles are rigidly attached to the annular surface in a known manner.

Bearing means are provided at the contact points between the paddle wheel and the inner walls of the upper and lower sections of the casing.

Locking means are also provided at the lower end of the shaft, serving to removably secure the paddle wheel inside the casing and a bearing means is provided to prevent vertical free play of the wheel.

A water feed pipe is located in the handle and projects a short distance into the casing, having a nozzle which directs the water flow to the blades of the paddle wheel on one side thereof. The opposite end of this water feed pipe projects out of the grip end of the handle, being adapted for attachment to any suitable water source in a bath or sink.

As a secondary feature, the brush of the present invention is also provided with a liquid soap-dispensing means. To accomplish the latter, the shaft is made hollow and is adapted to be filled with luquid soap. The lower end of the shaft and the tightening means are each provided with a small channel in registry with one another through which the soap may be ejected. The upper end of the shaft is provided with a pump element to force the soap through the channels. This pump element is accessible on the top surface of the casing. Retaining means are provided to removably keep the pump element in place.

BRIEF DESCRIPTION OF THE DRAWINGS

The above will be more clearly understood by having referral to the preferred embodiment of the invention, illustrated by way of the accompanying drawings, in which.

Like numerals refer to like elements throughout the drawings.

DETAILED DESCRIPTION OF THE PREFERRED EMBODIMENT

Figure 1:
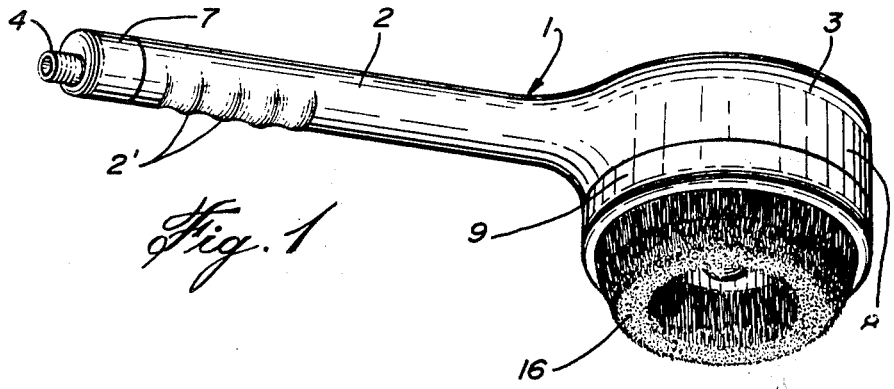
FIG. 1 is a perspective view of the brush.
Figure 2:
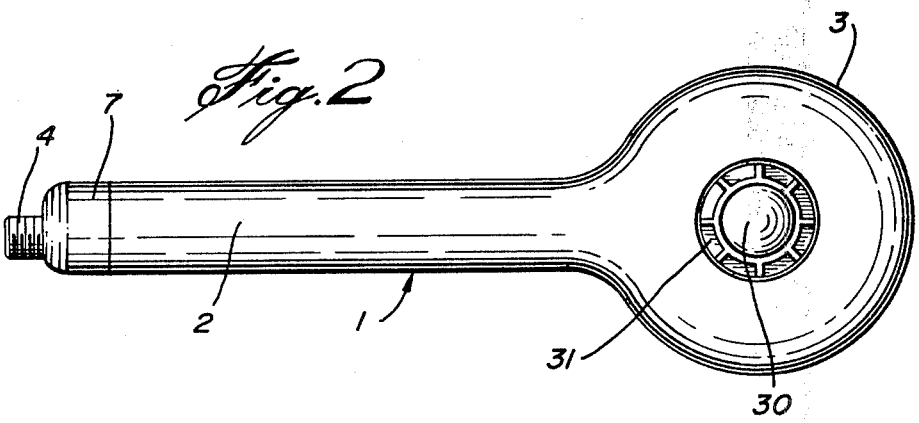
FIG. 2 is a top plan view of the brush.
Figure 3:
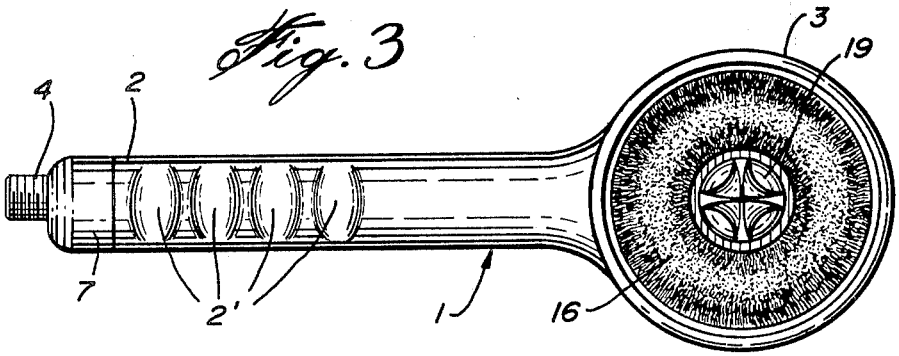
FIG. 3 is a bottom plan view of the brush.
Figure 4:
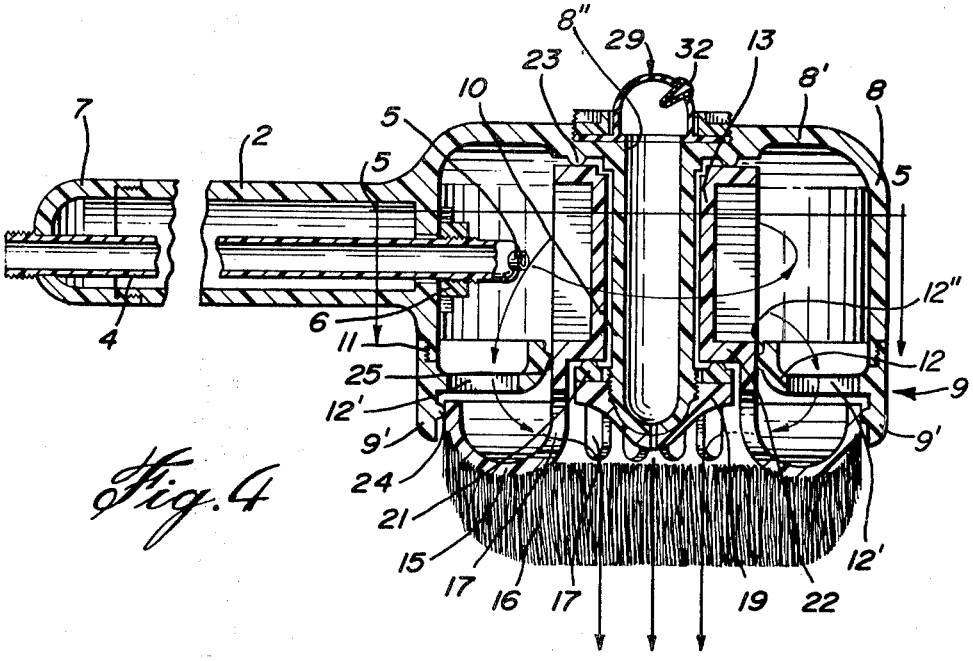
FIG. 4 is a vertical longitudinal section view of the brush wherein the arrows indicate the direction of water flow.

The brush 1 of the invention includes an elongated hollow handle 2 and a cylindrical casing 3 integrally formed therewith. Casing 3 has a cylindrical wall and two end walls 8' and 12, each having a central aperture 81" and 12", respectively. Handle 2 is preferably 12–14 inches long and its outer end portion is provided with grip protrusions 2' by which it may be grasped.

A water feed pipe 4, extending through handle 2, has a rear end projecting out of the latter, which is threaded, and is adapted for connection to a pressurized water supply, such as a sink or bath faucet (not shown). Feed pipe 4 also has a forward end projecting a short distance into casing 3 and terminating in a nozzle 5. This forward end is held in place by a collar 6 secured to the inner wall of casing 3.

The outer end of handle 2 is formed with a detachable threaded cap 7 to allow access to feed pipe 4.

Casing 3 incorporates two detachably-secured sections 8 and 9. Section 8 consists of end wall 8' and a portion of the cylindrical wall of the casing 3. Handle 2 extends orthogonally to said cylindrical wall portion. Section 8 is further integrally formed with a central, axially extending hollow shaft 10 surrounding and communicating with the central aperture 8'' of end wall 8'. The free end of this shaft 10 is hemi-spherical in shape.

The cylindrical wall portion of section 9 is adapted to be screwed onto the edge of the cylindrical wall portion of section 8 in end-to-end relation by threading, indicated at 11. The end wall 12 of casing 3 is provided with a plurality of circumferentially-spaced holes 12' through which the water coming from nozzle 5 may flow. Casing 3 has a skirt 9' which projects beyond end wall 12 and forms a continuation of the cylindrical wall of casing 3.

A paddle wheel 13 is rotatably mounted on the shaft 10 within casing 3. The former has a central cylindrical hub and a plurality of radial and spaced-apart paddles 14. The hub has an extension which projects from the central aperture of end wall 12 and forms an annular shape brush bristles carrying portion 15 which is half circular in cross-section. Portion 15 is axially spaced from and overlies end wall 12. Its free circular edge is in sliding and rotational engagment with skirt 9'. A plurality of hairs or bristles 16 are attached to this portion 15 and extend therefrom in a direction away from end walls 8' and 12. The radially inner part of portion 15 of paddle wheel 13 is provided with a plurality of circumferentially-spaced holes 17 through which water flows radially inwardly into bristles 16.

Figure 5:
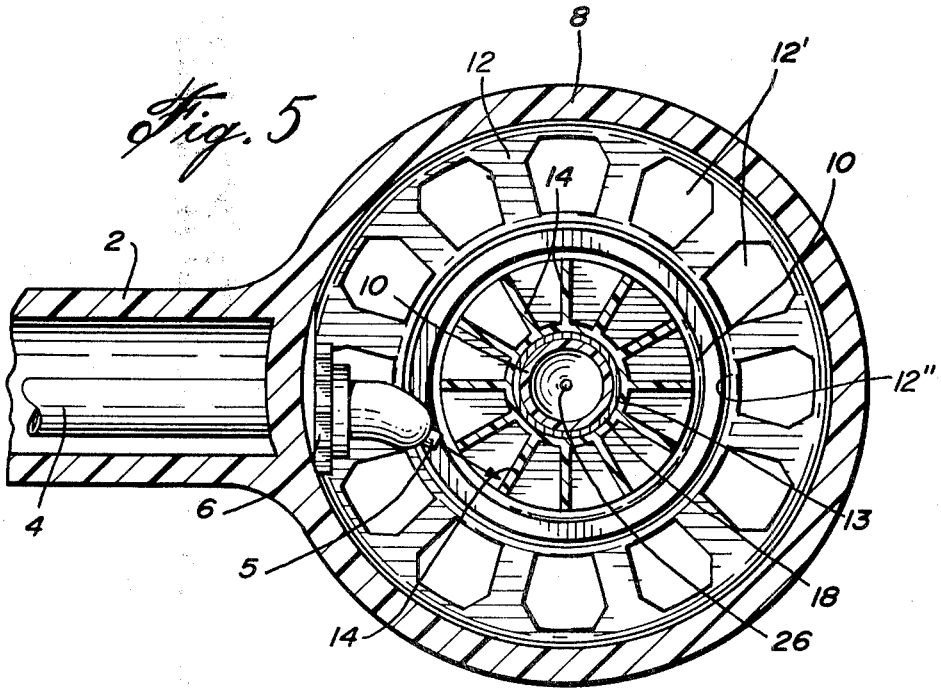
FIG. 5 is a plan section taken along line 5—5 of FIG. 4.
Figure 6:
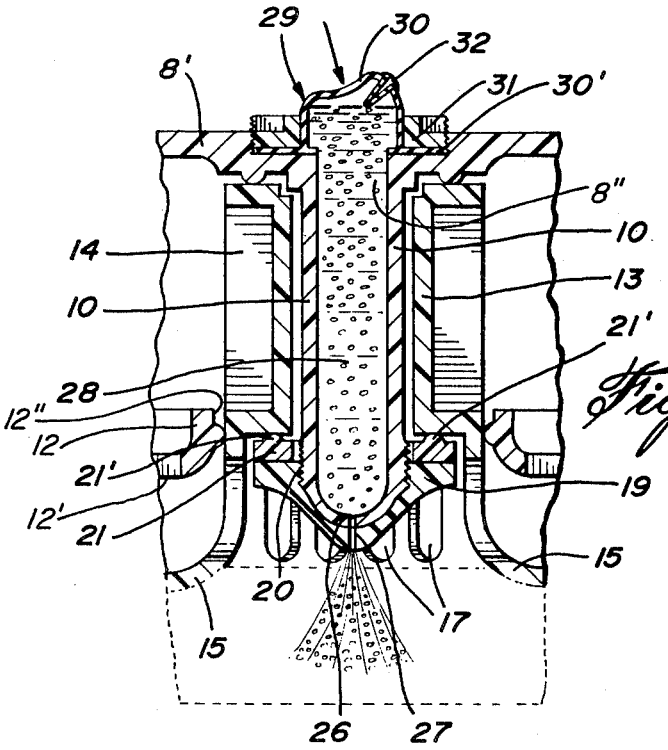
FIG. 6 is an enlarged vertical cross-section of the paddle wheel and soap dispenser, showing the latter full of liquid soap.
Figure 7:
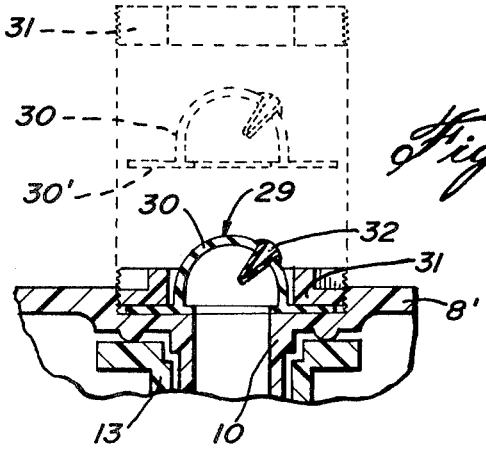
FIG. 7 is a vertical cross-section of the pump element, also showing in dashed outline the pump element and the retaining means.

To improve the smooth rotation of paddle wheel 13 about shaft 10, a cylindrical bushing 18 is located between paddle wheel 13 and shaft 10, as seen in FIG. 5.

A locking means is provided at the lower end of shaft 10 to secure paddle 13 in position, consisting of a nut 19 which can be screwed onto the free end of shaft 10 by threading, indicated at 20, until it abuts the hemispherical free end of shaft 10.

Positioned between nut 19 and the free end of shaft 10 is a washer 21, the function of this washer being to eliminate vertical free play of paddle wheel 13 on shaft 10. Washer 21 is also formed with an annular protuberance 21' which engage on elbow 22 on paddle wheel 13 as the latter rotates.

The inner surface of end wall 8' is also provided with a similar protuberance shown at 23. Similarly, section 9 is provided with protuberances, indicated at 24 and 25. Thus, paddle wheel 13 rotates smoothly without any vertical or lateral free play.

It will be readily apparent that paddle wheel 13 revolves under the action of water streaming out of nozzle 5 onto the paddles 14. As the water flows into bristles 16, a thorough cleansing and light message are obtained.

As an additional feature of the inventon, a liquid soap-dispensing means is provided: hollow shaft 10 can be filled with liquid soap 28. To eject the soap, a first narrow channel 26 is formed in the free end of shaft 10 which is in registry with a second narrow channel 27 formed in the center of nut 19.

A pump element 29 is provided at the fixed end of shaft 10 consisting of a hemispherical rubber cap 30, which is secured in place by a threaded annular member 31, the latter being screwable into the end wall 8' of casing 3. Cap 30 has a lower circular rim 30' over which member 31 is screwed. A one-way soap injector valve 32 is integrally formed in cap 30 for the injection of soap into shaft 10. It will be clear that, by pressing on cap 30, an amount of soap will flow through channels 26 and 27.

While the invention has been described according to the above preferred embodiment, it is to be understood that variations can be introduced without departing from its spirit or scope. For example, the length of the handle, or the overall size of the brush, may change. Also, the bristles may be made of different materials.

It is to be noted that all the elements described, except the bristles, are preferably made of rigid lightweight plastic material.

What I claim is:

1. A rotary brush comprising a casing having a cylindrical wall and first and second end walls, each having a central aperture, said casing formed of two sections, each including an end wall and a portion of said cylindrical wall, means to interconnect said cylindrical wall portions in end-to-end relation, the section including the second end wall having a skirt projecting beyond said second end wall, a hollow handle secured to and laterally extending from said cylindrical wall, a water feed pipe extending within said handle, having an outer end formed with means for connection to a water supply under pressure and an inner end defining a nozzle directed within said Commissioner of Patents and Trademarks February 3, 1983 casing, a hollow shaft extending within and coaxial with said casing, said shaft having a first end fixed to said first end wall and surrounding the central aperture of the latter, and a free end portion extending through the central aperture of said second end wall and beyond the latter, said free end portion being closed, except for a small discharge opening, a paddle wheel including a hub and radial paddles, the hub mounted on said shaft with the paddles extending in said casing to be impinged upon and rotated by a water jet issuing from said nozzle, said hub having an extension protruding through said central aperture of said second end wall and defining a radially-outwardly extending annular shape brush bristle-carrying portion axially spaced from and overlying said second end wall and having a free circular edge portion in sliding and rotational engagement with said skirt, brush bristles carried by said bristle-carrying portion and extending therefrom in a direction away from said end wall, axially of said shaft, to form an annular brush with a central open space, said second end wall and said brush-carrying portion having a plurality of holes allowing water within said casing to flow into said central space, said small discharge opening exposed within said central space, a flexible cap closing the central aperture of said first end wall and the first end of said hollow shaft, and means to fill said hollow shaft with a liquid detergent, pressure exerted on said flexible cap causing detergent to flow into said central space through said small discharge opening.

2. A brush as defined in claim 1, further including a nut threaded onto the free end of said shaft, and a washer located between said nut and said hub.

3. A brush as defined in claim 2, wherein bearing means for said paddle wheel are provided, consisting of, firstly, a cylindrical bushing placed between said shaft and the hub of said paddle wheel, and, secondly, first and second annular protuberances formed on the inner surface of said first end wall and on the inner surface of said skirt respectively, said first protuberance in sliding contact with said hub and said second protuberance in sliding contact with said free circular edge portion of said brush bristle-carrying portion.

* * * * *